US008579645B2

(12) United States Patent
Wang et al.

(10) Patent No.: US 8,579,645 B2
(45) Date of Patent: Nov. 12, 2013

(54) CONNECTOR MECHANISM FOR CONNECTING A BOARD CARD

(75) Inventors: Kuo-Jung Wang, New Taipei (TW); Chih-Chin Yang, New Taipei (TW); Yu-Ming Chiu, New Taipei (TW); Chun-Lung Hsiao, New Taipei (TW); Ming-Chen Chiu, New Taipei (TW); Jen-Hao Liu, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 84 days.

(21) Appl. No.: 13/430,724

(22) Filed: Mar. 27, 2012

(65) Prior Publication Data

US 2012/0289066 A1 Nov. 15, 2012

(30) Foreign Application Priority Data

May 10, 2011 (TW) ..... 100116324 A

(51) Int. Cl.
*H01R 13/62* (2006.01)

(52) U.S. Cl.
USPC ..... 439/326

(58) Field of Classification Search
USPC ..... 439/326, 330, 31, 65, 74
See application file for complete search history.

(56) References Cited

U.S. PATENT DOCUMENTS 4,235,496 A * 11/1980 Aug et al. ..... 439/157
4,426,122 A * 1/1984 Lainez et al. ..... 361/679.55
5,211,566 A * 5/1993 Bates et al. ..... 439/66
5,268,820 A * 12/1993 Tseng et al. ..... 361/785
5,460,537 A * 10/1995 Noschese ..... 439/325
5,795,172 A * 8/1998 Shahriari et al. ..... 439/260
6,065,989 A * 5/2000 Walkup et al. ..... 439/341
6,227,893 B1 * 5/2001 Kaneko ..... 439/326
6,302,713 B1 * 10/2001 Lai ..... 439/131
6,524,114 B2 * 2/2003 Watanabe et al. ..... 439/65
6,527,572 B2 * 3/2003 Jou ..... 439/248
6,722,920 B2 * 4/2004 Zhang ..... 439/571
7,084,654 B2 * 8/2006 Zhao et al. ..... 324/754.03
7,101,191 B2 * 9/2006 Benham et al. ..... 439/65
7,134,896 B1 * 11/2006 Chen ..... 439/326
7,182,618 B1 * 2/2007 Choy et al. ..... 439/328
7,241,159 B1 * 7/2007 Chen ..... 439/326
7,267,550 B1 * 9/2007 Eckberg et al. ..... 439/65
7,300,298 B2 * 11/2007 Kameda ..... 439/326
7,309,259 B2 * 12/2007 Sun et al. ..... 439/630
7,470,136 B2 * 12/2008 Yahiro et al. ..... 439/326
7,540,742 B2 * 6/2009 Hardell ..... 439/65
7,682,179 B1 * 3/2010 Tsai ..... 439/326
7,717,727 B2 * 5/2010 Li ..... 439/328
7,828,574 B2 * 11/2010 Zhu ..... 439/328
8,109,777 B2 * 2/2012 Zhu ..... 439/326
2003/0139093 A1 * 7/2003 Zhang ..... 439/571

* cited by examiner

*Primary Examiner* — Amy Cohen Johnson
*Assistant Examiner* — Vladimir Imas
(74) *Attorney, Agent, or Firm* — Winston Hsu; Scott Margo

(57) ABSTRACT

A connector mechanism for connecting a board card is disclosed. The connector mechanism includes a circuit board, and a connector installed on the circuit board. An end of the board card is for inserting into the connector. The connector mechanism further includes a socket installed on the circuit board and located on a side of the connector, a rotating component pivoted to the socket, and at least one connecting component slidably installed on the rotating component and coupled to the circuit board for contacting with the other end of the board card so as to electrically connect to the board card as the end of the board card is inserted into the connector and the rotating component rotates to a connection position.

8 Claims, 7 Drawing Sheets

CONNECTOR MECHANISM FOR CONNECTING A BOARD CARD

BACKGROUND OF THE INVENTION

1. Field of the Invention

The present invention relates to a connector mechanism for connecting a board card, and more specifically, to a connector mechanism capable of adjusting positions of the connecting components thereof according to board cards conforming to different specification.

2. Description of the Prior Art

Portable computers, such as notebook computers and tablet computers, are now commonly used for personal computing. Because they are small and light, notebook computers are suitable to be taken out of the home or office for document processing. Because wireless transmission techniques are maturing, hard-wired connections with electric network lines are no longer needed to transmit electrical signals, and signals may be received or transmitted from anywhere in a wireless manner by an antenna. In general, a wireless network card can transmit wireless signals conforming to corresponding specification. Cables are often utilized to connect the antenna module and the wireless network card in conventional mechanical design of a connector of the wireless network card. However, it often decays signal intensity and increases manufacture cost, assembly labor hour and assembly complexity. Furthermore, the cables might be broken as passing through a hinge connection of a display device and a host. For solving the above-mentioned problems, the antenna can be disposed on a circuit board for reducing signal decay, manufacture cost, assembly labor hour and assembly complexity and for protecting wires thereof. However, distances between joints of the wireless network cards conforming to different specification for connecting the antennas are not uniform, and the connector structure and the circuit board are needed to be redesigned and remolded as applying for the wireless network cards conforming to different specification so as to reduce utilization flexibility of the conventional connector mechanism.

SUMMARY OF THE INVENTION

The present invention provides a connector mechanism capable of adjusting positions of the connecting components thereof according to board cards conforming to different specification, to solve the problems mentioned above.

According to the claimed invention, a connector mechanism for connecting a board card is disclosed. The connector mechanism includes a circuit board, and a connector installed on the circuit board. An end of the board card is for inserting into the connector. The connector mechanism further includes a socket installed on the circuit board and located on a side of the connector, a rotating component pivoted to the socket, and at least one connecting component slidably installed on the rotating component and coupled to the circuit board for contacting with the other end of the board card so as to electrically connect to the board card as the end of the board card is inserted into the connector and the rotating component rotates to a connection position.

According to the claimed invention, at least one inclined structure is formed on the socket for guiding the other end of the board card to a position substantially parallel to the circuit board and then for pressing against the other end of the board card.

According to the claimed invention, at least one slot is formed on the rotating component, and the at least one connecting component is slidably installed inside the at least one slot.

According to the claimed invention, the connection mechanism further includes at least one locking component for locking the board card on the circuit board as the board card is located at the position substantially parallel to the circuit board.

According to the claimed invention, at least one antenna printed circuit is disposed on the circuit board and coupled to the at least one connecting component.

According to the claimed invention, the rotating component is substantially parallel to the circuit board as rotating to the connection position.

According to the claimed invention, the at least one connecting component comprises two connecting components, and the two connecting components are slidably installed on the rotating component relative to each other.

According to the claimed invention, a distance between the two connecting components is adjusted according to positions of two contacts of the board card.

The connection mechanism of the present invention applies for mechanical design of the antenna directly disposed on the circuit board, and it can reduce signal decay, save manufacture cost, reduce assembly labor hour and assembly complexity, and prevent an issue of broken cables. Furthermore, the connector mechanism of the present invention can adjust positions of the connecting components thereof for suiting with the corresponding board card. Hence, it can solve the problem that the conventional connector structure and the circuit board are needed to be redesigned and remolded as applying for the wireless network cards conforming to different specification, and it enhances utilization flexibility of the connector mechanism of the present invention.

These and other objectives of the present invention will no doubt become obvious to those of ordinary skill in the art after reading the following detailed description of the embodiment that is illustrated in the various figures and drawings.

DETAILED DESCRIPTION

Figure 1:
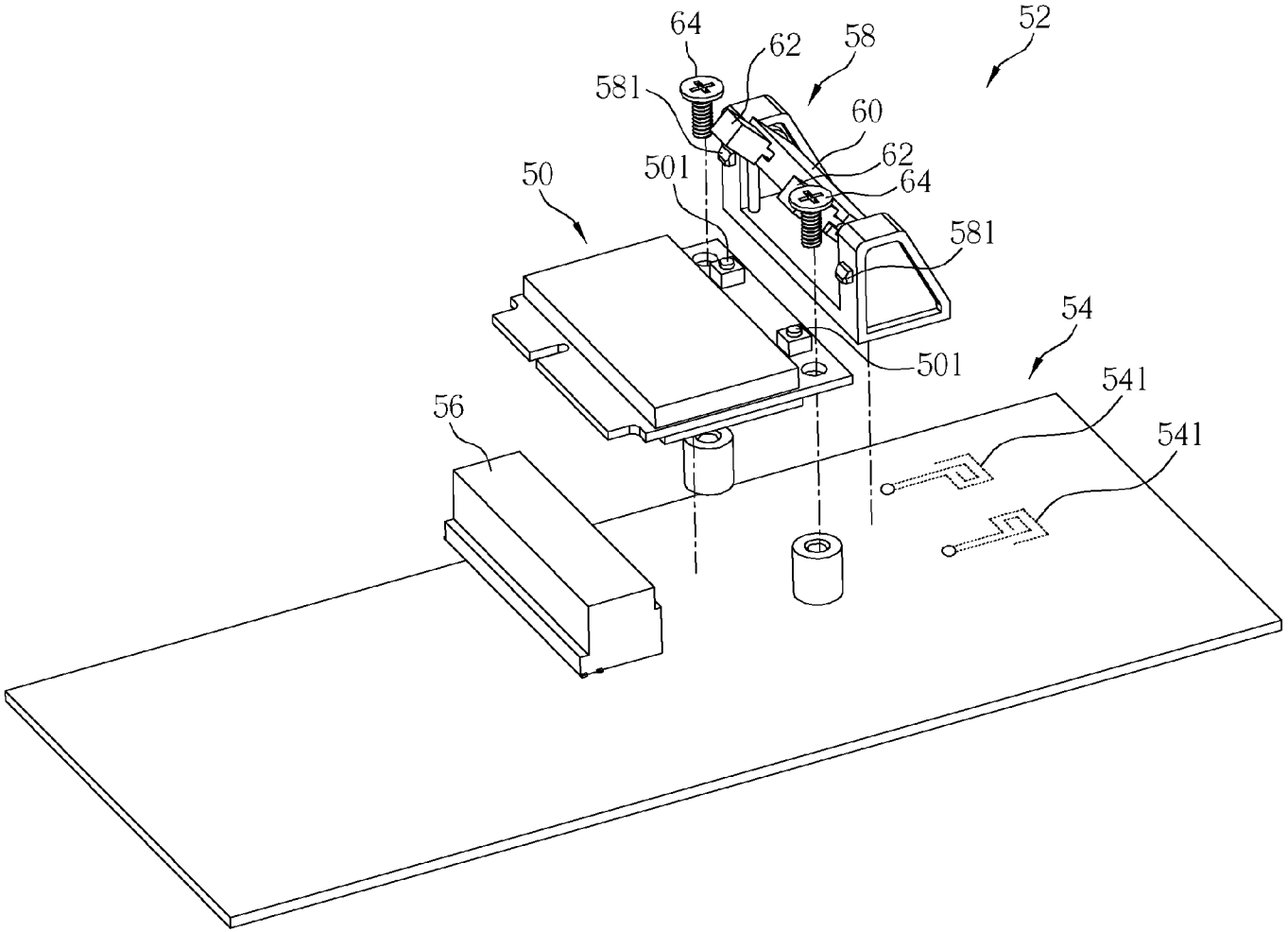
FIG. 1 is an exploded drawing of a connector mechanism for connecting a board card according to an embodiment of the present invention.
Figure 2:
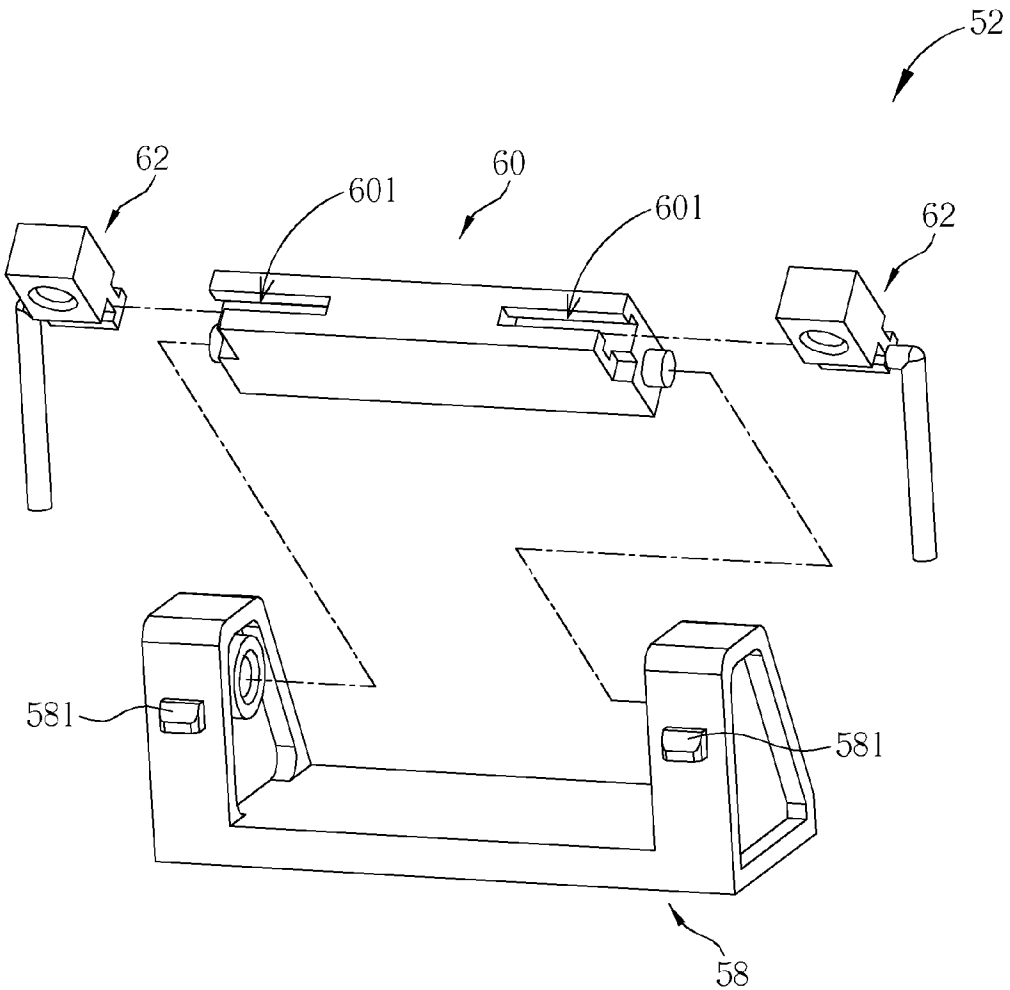
FIG. 2 is a partial exploded drawing of the connector mechanism in another view according to the embodiment of the present invention.

Please refer to FIG. 1. FIG. 1 is an exploded drawing of a connector mechanism 52 for connecting a board card 50 according to an embodiment of the present invention. The board card 50 can be a wireless network card, such as a wireless local area network (WLAN) card or a wireless wide area network (WWAN) card and so on, and can be installed inside a notebook computer. The connector mechanism 52 includes a circuit board 54, which can be a printed circuit board. At least one antenna printed circuit 541 can be disposed on the circuit board 54 for receiving and transmitting wireless signals. The connector mechanism 52 further includes a connector 56 installed on the circuit board 54, and an end of the board card 50 is for inserting into the connector 56 to transmit signals with the circuit board 54. Please to FIG. 1 and FIG. 2. FIG. 2 is a partial exploded drawing of the connector mechanism 52 in another view according to the embodiment of the present invention. The connector mechanism 52 further includes a socket 58 installed on the circuit board 54 and located on a side of the connector 56. At least one inclined structure 581 is formed on the socket 58 for guiding the other end of the board card 50 to a position substantially parallel to the circuit board 54 and then for pressing against the other end of the board card 50. In this embodiment, there are two inclined structures 581 disposed on two sides of the socket 58. The disposal and amount of the inclined structure 581 are not limited to those of the embodiment, and it depends on actual design demand. The connector mechanism 52 further includes a rotating component 60 pivoted to the socket 58. At least one slot 601 is formed on the rotating component 60. In this embodiment, there are two slots 601 disposed on two sides of the rotating component 60. The disposal and amount of the slot 601 are not limited to those of the embodiment, and it depends on actual design demand.

The connector mechanism 52 further includes at least one connecting component 62 slidably installed inside the slot 601 on the rotating component 60 and coupled to the antenna printed circuit 541 of the circuit board 54, such as contacting with contacts of the antenna printed circuit 541 via internal wires. In this embodiment, the connector mechanism 52 includes two connecting component 62 slidably installed inside the two slots 601 on the rotating component 60 respectively. The disposal and amount of the connecting component 62 are not limited to those of the embodiment, and it depends on actual design demand. The two connecting components 62 respectively contact with two contacts 501 on the other end of the board card 50 for electrically connecting to the board card 50 so that the board card 50 and the antenna printed circuit 541 on the circuit board 54 can transmit signal with each other, as the end of the board card 50 is inserted into the connector 56 and the rotating component 60 rotates to a connection position. The connector mechanism 52 further includes at least one locking component 64 for locking the board card 50 on the circuit board 54 as the board card 50 is located at the position substantially parallel to the circuit board 54, so as to fix the board card 50. The locking component 64 can be composed of a screw and a boss. In this embodiment, the connector mechanism 52 includes two locking components 64 locked on two sides of the board card 50 respectively. The disposal and amount of the locking component 64 are not limited to those of the embodiment, and it depends on actual design demand.

Figure 3:
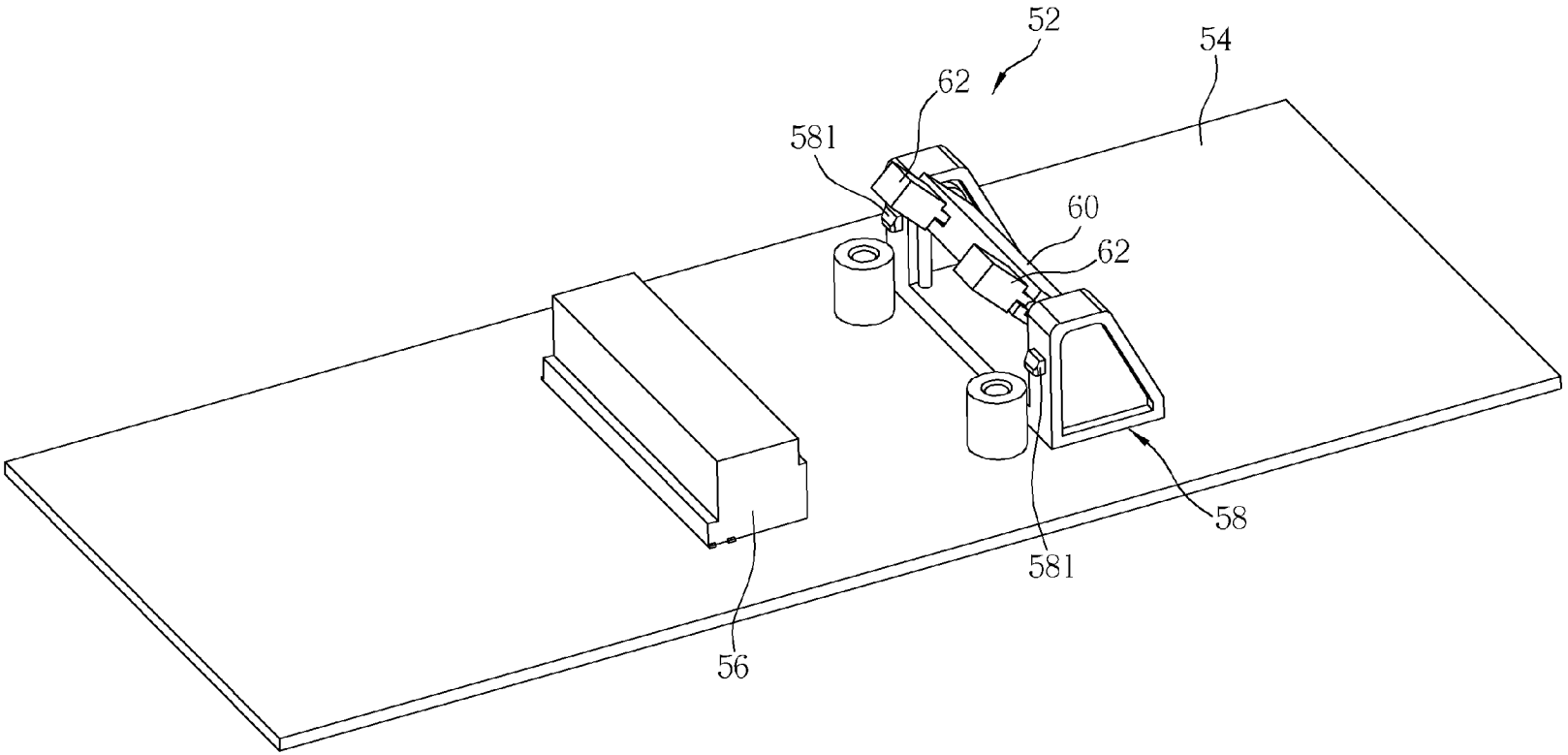
FIG. 3 to FIG. 7 are assembly diagrams illustrating that the connector mechanism connects with the board card according to the embodiment of the present invention.
Figure 4:
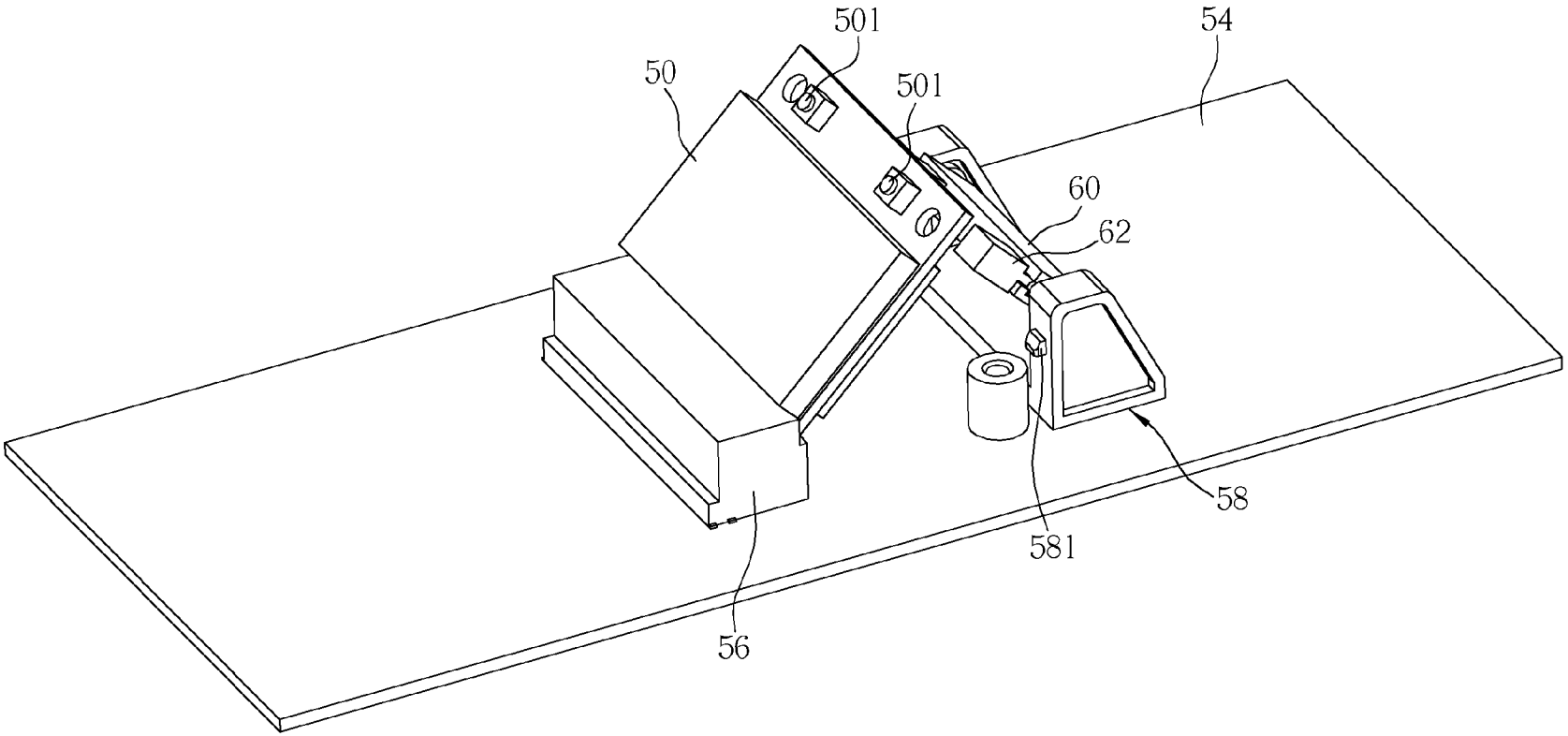
Figure 5:
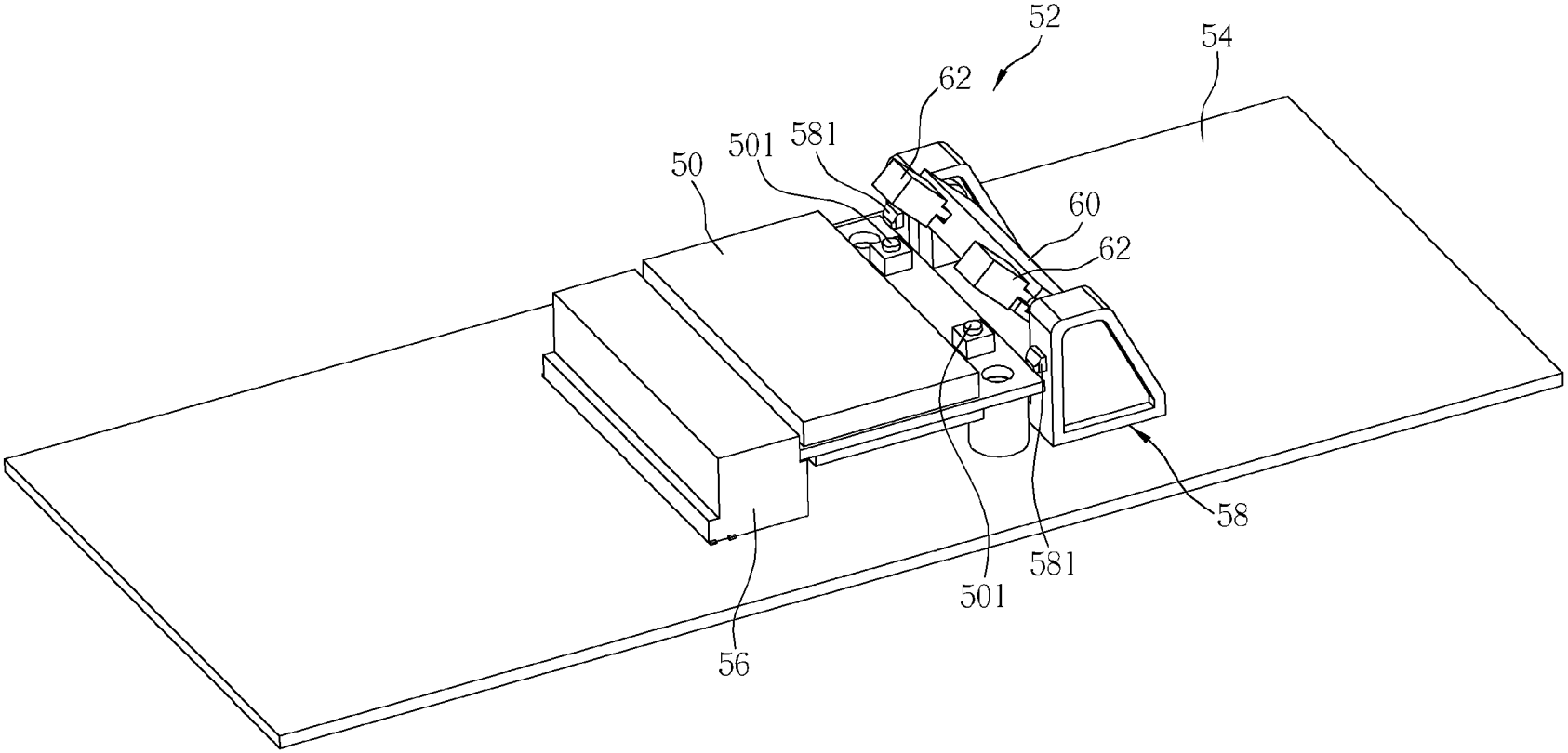
Figure 6:
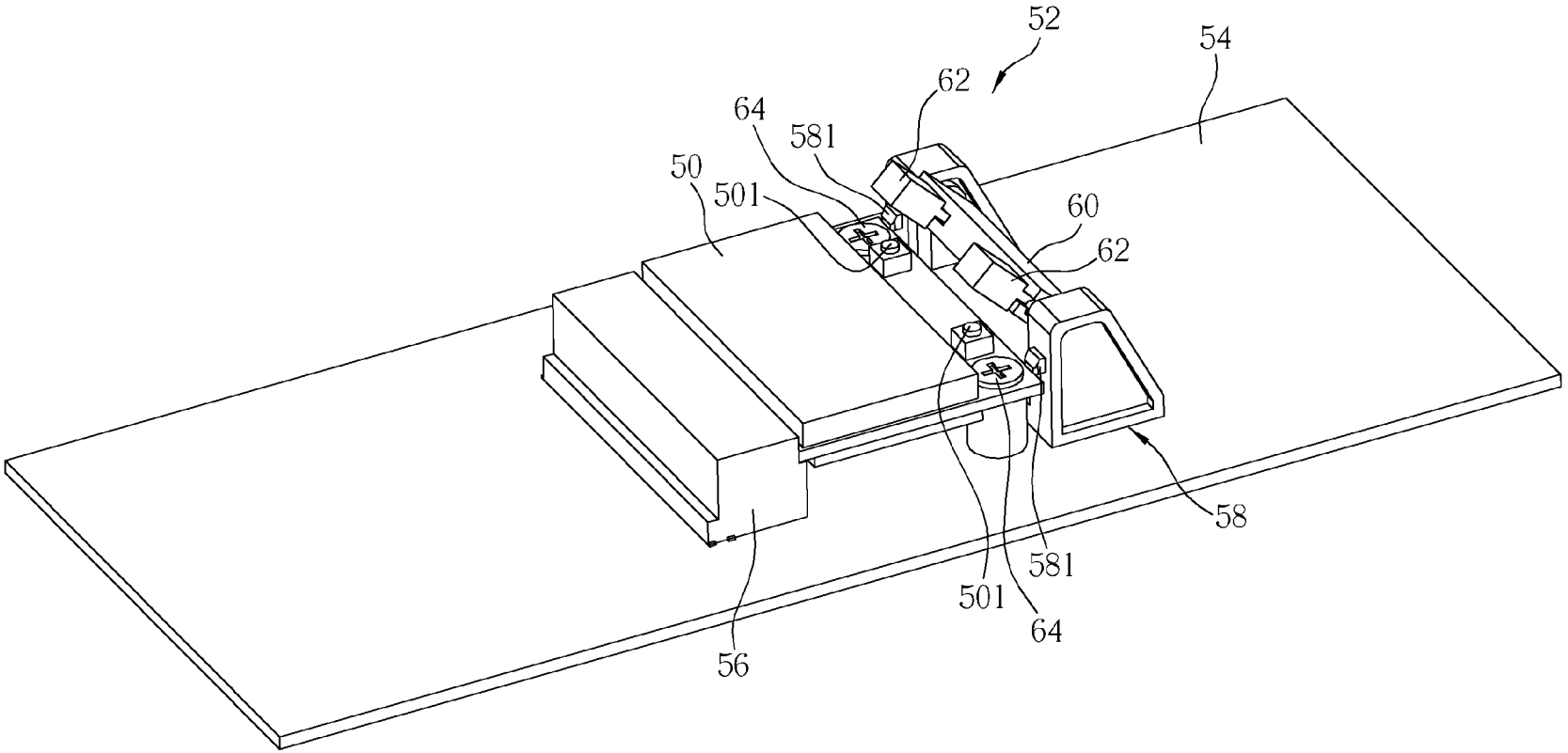
Figure 7:
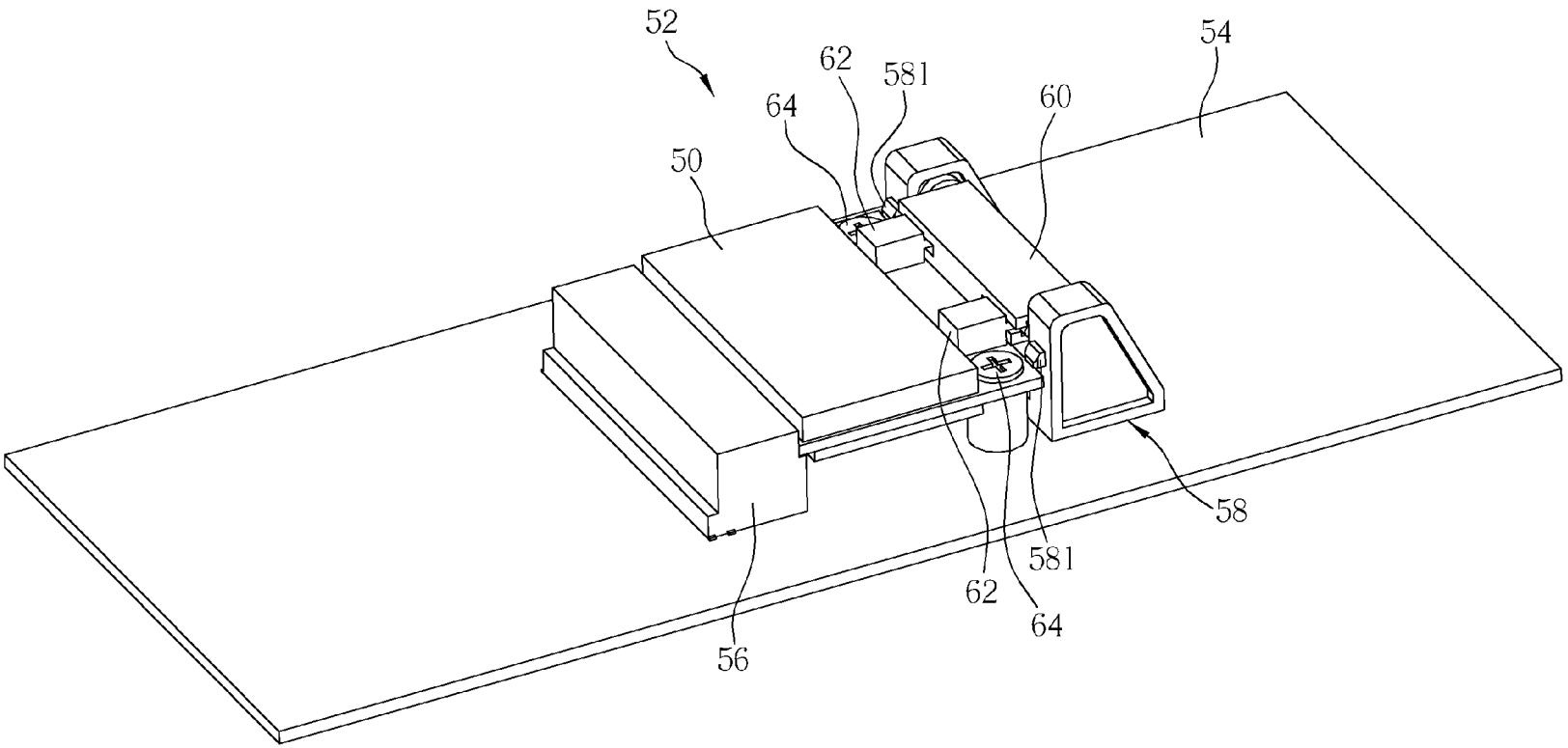

Please refer to FIG. 3 to FIG. 7. FIG. 3 to FIG. 7 are assembly diagrams illustrating that the connector mechanism 52 connects with the board card 50 according to the embodiment of the present invention. As shown in FIG. 3, the rotating component 60 is rotated away from the circuit board 54 relative to the socket 58 first, so as to leave space for installing the board card 50. As shown in FIG. 4, the end of the board card 50 is inserted into the connector 56, and the board card 50 is rotated close to the circuit board 54 to a position substantially parallel to the circuit board 54 as shown in FIG. 5. The inclined structure 581 on the socket 58 can guide the other end of the board card 50 to the position substantially parallel to the circuit board 54 and then press against the other end of the board card 50 so as to position the board card 50. As shown in FIG. 6, the two locking components 64 are locked on the two sides of the board card 50 so as to fix the board card 50 on the circuit board 54. At last, the rotating component 60 is rotated close to the circuit board 54 relative to the socket 58. As the rotating component 60 is rotated to the connection position as shown in FIG. 7, the rotating component 60 is substantially parallel to the circuit board 54 and the two connecting components 62 respectively contact with the two contacts 501 on the other end of the board card 50 for electrically connecting to the board card 50 so that the board card 50 and the antenna printed circuit 541 on the circuit board 54 can transmit signal with each other. Because the two connecting components 62 are slidably installed inside the two slots 601 on the rotating component 60 respectively, a distance between the two connecting components 62 can be adjusted according to positions of the two contacts 501 of the board card 50. That is, as the connector mechanism 52 is for connecting the board cards 50 having the two contacts 501 with different distances therebetween conforming to different specification, the positions of the two connecting components 62 of the present invention can be adjusted for respectively contacting with the corresponding contacts 501. It can solve the problem that the conventional connector structure and the circuit board are needed to be redesigned and remolded as applying for the wireless network cards conforming to different specification, and it enhances utilization flexibility of the connector mechanism 52 of the present invention.

In contrast to the prior art, the connection mechanism of the present invention applies for mechanical design of the antenna directly disposed on the circuit board, and it can reduce signal decay, save manufacture cost, reduce assembly labor hour and assembly complexity, and prevent an issue of broken cables. Furthermore, the connector mechanism of the present invention can adjust positions of the connecting components thereof for suiting with the corresponding board card. Hence, it can solve the problem that the conventional connector structure and the circuit board are needed to be redesigned and remolded as applying for the wireless network cards conforming to different specification, and it enhances utilization flexibility of the connector mechanism of the present invention.

Those skilled in the art will readily observe that numerous modifications and alterations of the device and method may be made while retaining the teachings of the invention.

What is claimed is:

1. A connector mechanism for connecting a board card, comprising:
- a circuit board;
- a connector installed on the circuit board, an end of the board card being for inserting into the connector;
- a socket installed on the circuit board and located on a side of the connector;
- a rotating component pivoted to the socket; and
- at least one connecting component slidably installed on the rotating component and coupled to the circuit board for contacting with the other end of the board card so as to electrically connect to the board card as the end of the board card is inserted into the connector and the rotating component rotates to a connection position.

2. The connector mechanism of claim 1, wherein at least one inclined structure is formed on the socket for guiding the other end of the board card to a position substantially parallel to the circuit board and then for pressing against the other end of the board card.

3. The connector mechanism of claim 1, wherein at least one slot is formed on the rotating component, and the at least one connecting component is slidably installed inside the at least one slot.

4. The connector mechanism of claim 1, further comprising at least one locking component for locking the board card on the circuit board as the board card is located at the position substantially parallel to the circuit board.

5. The connector mechanism of claim 1, wherein at least one antenna printed circuit is disposed on the circuit board and coupled to the at least one connecting component.

6. The connector mechanism of claim 1, wherein the rotating component is substantially parallel to the circuit board as rotating to the connection position.

7. The connector mechanism of claim 1, wherein the at least one connecting component comprises two connecting components, and the two connecting components are slidably installed on the rotating component relative to each other.

8. The connector mechanism of claim 7, wherein a distance between the two connecting components is adjusted according to positions of two contacts of the board card.

* * * * *